US011332695B2

(12) United States Patent
Allison

(10) Patent No.: US 11,332,695 B2
(45) Date of Patent: May 17, 2022

(54) WAX FORMULATIONS COMPRISING HIGH MOLECULAR WEIGHT SYNTHETIC LINEAR PRIMARY ALCOHOLS

(71) Applicant: FIRMENICH SA, Satigny (CH)

(72) Inventor: Gerald Allison, Plainsboro, NJ (US)

(73) Assignee: Firmenich SA, Satigny (CH)

( * ) Notice: Subject to any disclaimer, the term of this patent is extended or adjusted under 35 U.S.C. 154(b) by 0 days.

(21) Appl. No.: 16/611,175

(22) PCT Filed: May 9, 2018

(86) PCT No.: PCT/EP2018/062022
§ 371 (c)(1),
(2) Date: Nov. 5, 2019

(87) PCT Pub. No.: WO2018/206654
PCT Pub. Date: Nov. 15, 2018

(65) Prior Publication Data

US 2020/0080025 A1 Mar. 12, 2020

Related U.S. Application Data

(60) Provisional application No. 62/504,214, filed on May 10, 2017.

(30) Foreign Application Priority Data

Jun. 19, 2017 (EP) ..... 17176676

(51) Int. Cl.
*C11C 5/00* (2006.01)

(52) U.S. Cl.
CPC ..... *C11C 5/002* (2013.01)

(58) Field of Classification Search
None
See application file for complete search history.

(56) References Cited

U.S. PATENT DOCUMENTS

| | | | | |
|---|---|---|---|---|
| 7,410,513 | B2 * | 8/2008 | Requejo | A61L 9/02 44/275 |
| 10,988,434 | B2 * | 4/2021 | Chandrasekaran | C07C 69/593 |
| 2003/0064336 | A1 | 4/2003 | Welch et al. | |
| 2004/0040200 | A1 * | 3/2004 | Foster | C11C 5/002 44/275 |
| 2004/0068920 | A1 | 4/2004 | Steele et al. | |
| 2004/0088906 | A1 * | 5/2004 | Requejo | C11C 5/023 44/275 |
| 2006/0254125 | A1 | 11/2006 | Tully et al. | |
| 2008/0028670 | A1 * | 2/2008 | Tully | C11C 5/002 44/275 |
| 2010/0024281 | A1 * | 2/2010 | Lemke | C08L 91/00 44/275 |
| 2010/0212214 | A1 | 8/2010 | Wu et al. | |
| 2013/0280409 | A1 | 10/2013 | Mushock et al. | |
| 2016/0376523 | A1 * | 12/2016 | Kang | A61K 31/23 424/65 |
| 2019/0184364 | A1 * | 6/2019 | Brahms | A23L 27/72 |
| 2021/0079316 | A1 * | 3/2021 | Allison | C11C 5/002 |

FOREIGN PATENT DOCUMENTS

| | | | | |
|---|---|---|---|---|
| CA | 2019353 | A1 | 10/1991 | |
| EP | 1159950 | A1 * | 12/2001 | A61K 8/8111 |
| EP | 2106704 | A1 * | 10/2009 | C11D 3/06 |

OTHER PUBLICATIONS

UNILIN Alcohols Baker Petrollite 2011 (Year: 2011).*
ASTM Designation E222-17, Standard Test Methods for Hydroxyl Groups Using Acetic Anhydride Acetylation, (2017) (Year: 2017).*
"Volatile", New Oxford American Dictionary (3 ed., 2015) (Year: 2015).*
"Volatile." Merriam-Webster.com. 2020. https://www.merriam-webster.com (2020) (Year: 2020).*
N.G. Anderson, Practical Process & Research Development, Solvent Selection 81-111 (2000) (Year: 2000).*
G. Fráter et al., 54 Tetrahedron, 7633-7703 (1998) (Year: 1998).*
UNILIN Alcohols, Specialty polymers and waxes to meet your needs (Baker Hughes 2011) (Year: 2011).*
C Cronin JIPEL "Lost and Found: Intellectual Property of the Fragrance Industry; From Trade Secret to Trade Dress" (2016) (Year: 2016).*
R. Herz, "I Know What I Like: Understanding Odor Preferences" (2004) (Year: 2004).*
M. Teixeira et al., 49 Ind. Eng. Chem. Res., 11764-11777 (2010) (Year: 2010).*
International Search Report and Written Opinion for International Application No. PCT/EP2018/062022, dated Jul. 24, 2018. 19 pages.
Cattermole, "Honey Candles Beeswax Candles Gently Infused with Pure Essential Oils", Honey Candles 100% pure beeswax, Published Jul. 11, 2013, pp. 1-5.
Hunter et al., "Linear Polyethylenes and Long-Chain Alcohols in Underarm Sticks and Soft Solids", Cosmetics & Toiletries Magazine, Published Dec. 2003, pp. 1-4, vol. 118, No. 12.
ALZO International Inc., "NuLastic Surf: Innovative Silicone Elastomers", Published 2010, pp. 1-2 https://www.alzointernational.com/images/brochures/nulasticsurf.pdf.
Baker Hughes, "UNILIN Alcohols", Baker Hughes: Polymers, Published 2011, pp. 1-2.
Tulloch, "The Composition of Beeswax and Other Waxes Secreted by Insects", Lipids, Published Feb. 1, 1970, pp. 247-258, vol. 5, No. 2.
"Calendula Officinalis Flower Extract", International Cosmetic Ingredient Dictionary and Handbook, Published 2000, pp. 191-192.
Baker Hughes "Performacol Alcohols", Baker Hughes: New Phase Technologies, Published 2012, pp. 1-2.

* cited by examiner

*Primary Examiner* — Alexander R Pagano

(57) ABSTRACT

Described herein are wax formulations and candles that contain synthetic linear primary alcohols. The wax formulations and candles exhibit one or more desirable properties, such as good flame height, good fragrance character, low mineral impurity levels and little or no discoloration.

10 Claims, No Drawings

WAX FORMULATIONS COMPRISING HIGH MOLECULAR WEIGHT SYNTHETIC LINEAR PRIMARY ALCOHOLS

CROSS REFERENCE TO RELATED APPLICATIONS

The present application is a U.S. National Phase Application of PCT/EP2018/062022, filed on May 9, 2018, which claims the benefit of priority to U.S. Provisional Patent Application Ser. No. 62/504,214, filed on May 10, 2017, and also claims the benefit of priority to European Patent Application Serial No. 17176676.9, filed on Jun. 19, 2017, the entire contents of which are hereby incorporated by reference in their entirety.

FIELD

The various aspects presented herein relate to wax formulations and candles that contain synthetic linear primary alcohols. The wax formulations and candles exhibit one or more desirable properties, such as good flame height, good fragrance character, low mineral impurity levels and little or no discoloration.

BACKGROUND

The incorporation of fragrant oil(s) (perfumes) in candle wax is difficult to achieve in quantities sufficient to ensure the release of a suitable level of fragrance into the atmosphere for the end use customer. Incorporating high loadings of fragrances, particularly smaller, highly volatile perfumes, may result in migration and volatilization of the fragrance compound(s) being added during the candle making process. Migration of the fragrant compounds in the finished candle may lead to weeping or bleeding of the fragrant oils at the surface during storage. The candle making industry, therefore, has long searched for an effective technique of manufacture or an additive that would prevent or inhibit the separation of liquid oil additives and allows for incorporation of greater amounts of fragrance.

U.S. Patent Application Publication No. 2006/0254125 A1 discloses a composition suitable for use in candles comprising a wax, a fragrant compound, and a silicone.

U.S. Patent Application Publication No. 2003/0064336 A1 discloses the use of perfume-loaded porous inorganic carrier particles to produce intense and long-lasting fragrances.

U.S. Patent Application Publication No. 2004/0068920 A1 discloses a stabilized fragrance candle composition comprising wax, fragrance, and a stabilizing composition comprising an ultraviolet (UV) absorber and a hindered hydroxybenzoate.

Despite the approaches outlined above, there is a need for wax formulations, having improved fragrance dispersion properties.

SUMMARY

One Aspect Presented Herein, Provides a Composition Comprising:

a) a volatile active substance; and b) a high molecular weight linear primary alcohol, wherein the high molecular weight linear primary alcohol is present in the composition in an amount sufficient to improve the dispersion of the volatile active substance, when the composition is incorporated into a candle, compared to a dispersion of the volatile active substance that is incorporated into a candle lacking the high molecular weight linear primary alcohol, and wherein the hydroxyl number of the high molecular weight linear primary alcohol is from 66 to 110.

In one aspect, the composition further comprises a wax, selected from the group consisting of: a paraffin wax, a vegetable-based wax, and a mixture of a paraffin wax and a vegetable-based wax.

One Aspect Presented Herein, Provides a Composition Comprising:

a) a wax, selected from the group consisting of: a paraffin wax, a vegetable-based wax, and a mixture of a paraffin wax and a vegetable-based wax, b) a volatile active substance; and c) a high molecular weight linear primary alcohol, wherein the high molecular weight linear primary alcohol is present in the composition in an amount sufficient to improve the dispersion of the volatile active substance, when the composition is incorporated into a candle, compared to a dispersion of the volatile active substance that is incorporated into a candle lacking the high molecular weight linear primary alcohol, and wherein the hydroxyl number of the high molecular weight linear primary alcohol is from 66 to 110.

In one aspect, the volatile active substance comprises a polar fragrance molecule.

In one aspect, the high molecular weight linear primary alcohol has a melting point from 87 degrees Celsius to 110 degrees Celsius.

In one aspect, the iodine value of the high molecular weight linear primary alcohol does not exceed 2.

In one aspect, the sufficient amount of the high molecular weight linear primary alcohol is from 0.05% to 0.6% w/w of the composition when incorporated into a candle.

One aspect presented herein, provides a method comprising:

a) admixing i. a volatile active substance, and ii. a high molecular weight linear primary alcohol to form a mixture;

b) adding the mixture to a wax, selected from the group consisting of: a paraffin wax, a vegetable-based wax, and a mixture of a paraffin wax and a vegetable-based wax; and c) forming a candle from the mixture formed in step b, wherein the high molecular weight linear primary alcohol is present in the composition in an amount sufficient to improve the dispersion of the volatile active substance, when the composition is incorporated into a candle, compared to a dispersion of the volatile active substance that is incorporated into a candle lacking the high molecular weight linear primary alcohol, and wherein the hydroxyl number of the high molecular weight linear primary alcohol is from 66 to 110.

In one aspect, the volatile active substance comprises a polar fragrance molecule.

In one aspect, the high molecular weight linear primary alcohol has a melting point from 87 degrees Celsius to 110 degrees Celsius.

In one aspect, the iodine value of the high molecular weight linear primary alcohol does not exceed 2.

In one aspect, the sufficient amount of the high molecular weight linear primary alcohol is from 0.05% to 0.6% w/w of the composition when incorporated into a candle.

DETAILED DESCRIPTION

In the following description, reference is made to specific embodiments which may be practiced, which is shown by way of illustration. These embodiments are described in detail to enable those skilled in the art to practice the invention described herein, and it is to be understood that other embodiments may be utilized and that logical changes may be made without departing from the scope of the aspects presented herein. The following description of example embodiments is, therefore, not to be taken in a limited sense, and the scope of the various aspects presented herein is defined by the appended claims.

The Abstract is provided to comply with 37 C.F.R. § 1.72(b) to allow the reader to quickly ascertain the nature and gist of the technical disclosure. The Abstract is submitted with the understanding that it will not be used to interpret or limit the scope or meaning of the claims.

The incorporation of fragrant oil(s) (perfumes) in candle wax is difficult to achieve in quantities sufficient to ensure the release of a suitable level of fragrance into the atmosphere for the end use customer. Incorporating high loadings of fragrances, particularly smaller, highly volatile perfumes, may result in migration and volatilization of the fragrance compound(s) being added during the candle making process. Migration of the fragrant compounds in the finished candle may lead to weeping or bleeding of the fragrant oils at the surface during storage.

Accordingly, some aspects presented herein, provide a composition comprising:

a) a volatile active substance; and b) a high molecular weight linear primary alcohol, wherein the high molecular weight linear primary alcohol is present in the composition in an amount sufficient to improve the dispersion of the volatile active substance, when the composition is incorporated into a candle, compared to a dispersion of the volatile active substance that is incorporated into a candle lacking the high molecular weight linear primary alcohol, and wherein the hydroxyl number of the high molecular weight linear primary alcohol is from 66 to 110.

The dispersion of volatile active substance may be affected by a number of factors, including, but not limited to the polarity of the volatile active substance, type of wax, the molecular weight of the volatile active substance, the crystalline structure of the wax formulation, the extent and nature of hydrogen bonding between the wax and the volatile active substance, and the like.

Using paraffin wax as an illustration, paraffin wax is typically macrocrystalline and brittle. The solidified wax composition, at a microscopic level, includes wax crystals packed against each other. Components of a wax composition, such as colorant, are typically trapped in the spaces between wax crystals. Fragrance molecules, however, are typically too small to be held in these inter crystal (or interstitial) spaces.

Without intending to be limited to any particular theory, the high molecular weight linear primary alcohol improves the dispersion of the volatile active substance by disrupting the crystal packing of a wax formulation, by opening the interstitial space between wax crystals, thereby allowing the volatile active substance to infiltrate uniformly between the wax crystals.

In some aspects, the high molecular weight linear primary alcohol improves the dispersion of the volatile active substance by forming a composite mixture with the wax and fragrance. In some aspects, the high molecular weight linear primary alcohol increases the miscibility of the volatile active substance with the wax formulation.

In some aspects, the high molecular weight linear primary alcohol possesses a high degree of molecular order in the solid state. In some aspects, the density of the high molecular weight linear primary alcohol is about 0.985 g/cm$^3$.

In some aspects, the high molecular weight linear primary alcohol has a melting point from 87 degrees Celsius to 110 degrees Celsius. Alternatively, in some aspects, the high molecular weight linear primary alcohol has a melting point from 87 degrees Celsius to 109 degrees Celsius. Alternatively, in some aspects, the high molecular weight linear primary alcohol has a melting point from 87 degrees Celsius to 108 degrees Celsius. Alternatively, in some aspects, the high molecular weight linear primary alcohol has a melting point from 87 degrees Celsius to 107 degrees Celsius. Alternatively, in some aspects, the high molecular weight linear primary alcohol has a melting point from 87 degrees Celsius to 106 degrees Celsius. Alternatively, in some aspects, the high molecular weight linear primary alcohol has a melting point from 87 degrees Celsius to 105 degrees Celsius. Alternatively, in some aspects, the high molecular weight linear primary alcohol has a melting point from 87 degrees Celsius to 104 degrees Celsius. Alternatively, in some aspects, the high molecular weight linear primary alcohol has a melting point from 87 degrees Celsius to 103 degrees Celsius. Alternatively, in some aspects, the high molecular weight linear primary alcohol has a melting point from 87 degrees Celsius to 102 degrees Celsius. Alternatively, in some aspects, the high molecular weight linear primary alcohol has a melting point from 87 degrees Celsius to 101 degrees Celsius. Alternatively, in some aspects, the high molecular weight linear primary alcohol has a melting point from 87 degrees Celsius to 100 degrees Celsius. Alternatively, in some aspects, the high molecular weight linear primary alcohol has a melting point from 87 degrees Celsius to 99 degrees Celsius. Alternatively, in some aspects, the high molecular weight linear primary alcohol has a melting point from 87 degrees Celsius to 98 degrees Celsius. Alternatively, in some aspects, the high molecular weight linear primary alcohol has a melting point from 87 degrees Celsius to 97 degrees Celsius. Alternatively, in some aspects, the high molecular weight linear primary alcohol has a melting point from 87 degrees Celsius to 96 degrees Celsius. Alternatively, in some aspects, the high molecular weight linear primary alcohol has a melting point from 87 degrees Celsius to 95 degrees Celsius. Alternatively, in some aspects, the high molecular weight linear primary alcohol has a melting point from 87 degrees Celsius to 94 degrees Celsius. Alternatively, in some aspects, the high molecular weight linear primary alcohol has a melting point from 87 degrees Celsius to 93 degrees Celsius. Alternatively, in some aspects, the high molecular weight linear primary alcohol has a melting point from 87 degrees Celsius to 92 degrees Celsius. Alternatively, in some aspects, the high molecular weight linear primary alcohol has a melting point from 87 degrees Celsius to 91 degrees Celsius. Alternatively, in some aspects, the high molecular weight linear primary alcohol has a melting point from 87 degrees Celsius to 90 degrees Celsius. Alternatively, in some aspects, the high molecular weight linear primary alcohol has a melting point from 87 degrees Celsius to 89 degrees Celsius. Alternatively, in some aspects, the high molecular weight linear primary alcohol has a melting point from 87 degrees Celsius to 88 degrees Celsius.

In some aspects, the high molecular weight linear primary alcohol has a melting point from 88 degrees Celsius to 110 degrees Celsius. Alternatively, in some aspects, the high molecular weight linear primary alcohol has a melting point from 89 degrees Celsius to 109 degrees Celsius. Alternatively, in some aspects, the high molecular weight linear primary alcohol has a melting point from 90 degrees Celsius to 109 degrees Celsius. Alternatively, in some aspects, the high molecular weight linear primary alcohol has a melting point from 91 degrees Celsius to 109 degrees Celsius. Alternatively, in some aspects, the high molecular weight linear primary alcohol has a melting point from 92 degrees Celsius to 109 degrees Celsius. Alternatively, in some aspects, the high molecular weight linear primary alcohol has a melting point from 93 degrees Celsius to 109 degrees Celsius. Alternatively, in some aspects, the high molecular weight linear primary alcohol has a melting point from 94 degrees Celsius to 109 degrees Celsius. Alternatively, in some aspects, the high molecular weight linear primary alcohol has a melting point from 95 degrees Celsius to 109 degrees Celsius. Alternatively, in some aspects, the high molecular weight linear primary alcohol has a melting point from 96 degrees Celsius to 109 degrees Celsius. Alternatively, in some aspects, the high molecular weight linear primary alcohol has a melting point from 97 degrees Celsius to 109 degrees Celsius. Alternatively, in some aspects, the high molecular weight linear primary alcohol has a melting point from 98 degrees Celsius to 109 degrees Celsius. Alternatively, in some aspects, the high molecular weight linear primary alcohol has a melting point from 99 degrees Celsius to 109 degrees Celsius. Alternatively, in some aspects, the high molecular weight linear primary alcohol has a melting point from 100 degrees Celsius to 109 degrees Celsius. Alternatively, in some aspects, the high molecular weight linear primary alcohol has a melting point from 101 degrees Celsius to 109 degrees Celsius. Alternatively, in some aspects, the high molecular weight linear primary alcohol has a melting point from 102 degrees Celsius to 109 degrees Celsius. Alternatively, in some aspects, the high molecular weight linear primary alcohol has a melting point from 103 degrees Celsius to 109 degrees Celsius. Alternatively, in some aspects, the high molecular weight linear primary alcohol has a melting point from 104 degrees Celsius to 109 degrees Celsius. Alternatively, in some aspects, the high molecular weight linear primary alcohol has a melting point from 105 degrees Celsius to 109 degrees Celsius. Alternatively, in some aspects, the high molecular weight linear primary alcohol has a melting point from 106 degrees Celsius to 109 degrees Celsius. Alternatively, in some aspects, the high molecular weight linear primary alcohol has a melting point from 107 degrees Celsius to 109 degrees Celsius. Alternatively, in some aspects, the high molecular weight linear primary alcohol has a melting point from 108 degrees Celsius to 109 degrees Celsius.

In some aspects, the melting point is 110 degrees Celsius, or, alternatively, 109, or 108, or 107, or 106, or 105, or 104, or 103, or 102, or 101, or 100, or 99, or 98, or 97, or 96, or 95, or 94, or 93, or 92, or 91, or 90, or 89, or 88, or 87 degrees Celsius.

In some aspects, the iodine value of the high molecular weight linear primary alcohol does not exceed 2. As used herein, the term "iodine value" refers to the mass of iodine in grams that is consumed by 100 grams of a chemical substance. The iodine value is used to determine the amount of unsaturation in fatty acids. In some aspects, the iodine value of the high molecular weight linear primary alcohol is from 0 to 2. Alternatively, in some aspects, the iodine value of the high molecular weight linear primary alcohol is from 0.1 to 2. Alternatively, in some aspects, the iodine value of the high molecular weight linear primary alcohol is from 0.2 to 2. Alternatively, in some aspects, the iodine value of the high molecular weight linear primary alcohol is from 0.3 to 2. Alternatively, in some aspects, the iodine value of the high molecular weight linear primary alcohol is from 0.4 to 2. Alternatively, in some aspects, the iodine value of the high molecular weight linear primary alcohol is from 0.5 to 2. Alternatively, in some aspects, the iodine value of the high molecular weight linear primary alcohol is from 0.6 to 2. Alternatively, in some aspects, the iodine value of the high molecular weight linear primary alcohol is from 0.7 to 2. Alternatively, in some aspects, the iodine value of the high molecular weight linear primary alcohol is from 0.8 to 2. Alternatively, in some aspects, the iodine value of the high molecular weight linear primary alcohol is from 0.9 to 2. Alternatively, in some aspects, the iodine value of the high molecular weight linear primary alcohol is from 1 to 2. Alternatively, in some aspects, the iodine value of the high molecular weight linear primary alcohol is from 1.1 to 2. Alternatively, in some aspects, the iodine value of the high molecular weight linear primary alcohol is from 1.2 to 2. Alternatively, in some aspects, the iodine value of the high molecular weight linear primary alcohol is from 1.3 to 2. Alternatively, in some aspects, the iodine value of the high molecular weight linear primary alcohol is from 1.4 to 2. Alternatively, in some aspects, the iodine value of the high molecular weight linear primary alcohol is from 1.5 to 2. Alternatively, in some aspects, the iodine value of the high molecular weight linear primary alcohol is from 1.6 to 2. Alternatively, in some aspects, the iodine value of the high molecular weight linear primary alcohol is from 1.7 to 2. Alternatively, in some aspects, the iodine value of the high molecular weight linear primary alcohol is from 1.8 to 2. Alternatively, in some aspects, the iodine value of the high molecular weight linear primary alcohol is from 1.9 to 2.

In some aspects, the iodine value of the high molecular weight linear primary alcohol is from 0 to 1.9. Alternatively, in some aspects, the iodine value of the high molecular weight linear primary alcohol is from 0.1 to 1.8. Alternatively, in some aspects, the iodine value of the high molecular weight linear primary alcohol is from 0.1 to 1.7. Alternatively, in some aspects, the iodine value of the high molecular weight linear primary alcohol is from 0.1 to 1.6. Alternatively, in some aspects, the iodine value of the high molecular weight linear primary alcohol is from 0.1 to 1.5. Alternatively, in some aspects, the iodine value of the high molecular weight linear primary alcohol is from 0.1 to 1.4. Alternatively, in some aspects, the iodine value of the high molecular weight linear primary alcohol is from 0.1 to 1.3. Alternatively, in some aspects, the iodine value of the high molecular weight linear primary alcohol is from 0.1 to 1.2. Alternatively, in some aspects, the iodine value of the high molecular weight linear primary alcohol is from 0.1 to 1.1. Alternatively, in some aspects, the iodine value of the high molecular weight linear primary alcohol is from 0.1 to 1. Alternatively, in some aspects, the iodine value of the high molecular weight linear primary alcohol is from 0 to 0.9. Alternatively, in some aspects, the iodine value of the high molecular weight linear primary alcohol is from 0.1 to 0.8. Alternatively, in some aspects, the iodine value of the high molecular weight linear primary alcohol is from 0.1 to 0.7.

Alternatively, in some aspects, the iodine value of the high molecular weight linear primary alcohol is from 0.1 to 0.6. Alternatively, in some aspects, the iodine value of the high molecular weight linear primary alcohol is from 0.1 to 0.5. Alternatively, in some aspects, the iodine value of the high molecular weight linear primary alcohol is from 0.1 to 0.4. Alternatively, in some aspects, the iodine value of the high molecular weight linear primary alcohol is from 0.1 to 0.3. Alternatively, in some aspects, the iodine value of the high molecular weight linear primary alcohol is from 0.1 to 0.2.

In some aspects, the iodine value of the high molecular weight linear primary alcohol is 2. Alternatively, in some aspects, the iodine value is 1.9, or 1.8, or 1.7, or 1.6, or 1.5, or 1.4, or 1.3, or 1.2, or 1.1, or 1.0, or 0.9, or 0.8, or 0.7, or 0.6, or 0.5, or 0.4, or 0.3, or 0.2, or 0.1, or 0.

In some aspects, the high molecular weight linear primary alcohol is fully saturated. In some aspects, the high molecular weight linear primary alcohol is fully unsaturated. In some aspects, the high molecular weight linear primary alcohol is 100%, or 90%, or 80%, or 70%, or 60%, or 50%, or 40%, or 30%, or 20%, or 10%, or 9%, or 8%, or 7%, or 6%, or 5%, or 4%, or 3%, or 2%, or 1%, or 0% saturated.

In some aspects, the high molecular weight linear primary alcohol has the formula $C_{48}H_{97}OH$. In some aspects, the high molecular weight linear primary alcohol has the formula $C_{50}H_{101}OH$.

In some aspects, the hydroxyl number (defined as mg KOH/g sample) of the high molecular weight linear primary alcohol is from 50 to 110. Alternatively, in some aspects, the hydroxyl number of the high molecular weight linear primary alcohol is from 50 to 109. Alternatively, in some aspects, the hydroxyl number of the high molecular weight linear primary alcohol is from 50 to 108. Alternatively, in some aspects, the hydroxyl number of the high molecular weight linear primary alcohol is from 50 to 107. Alternatively, in some aspects, the hydroxyl number of the high molecular weight linear primary alcohol is from 50 to 106. Alternatively, in some aspects, the hydroxyl number of the high molecular weight linear primary alcohol is from 50 to 105. Alternatively, in some aspects, the hydroxyl number of the high molecular weight linear primary alcohol is from 50 to 104. Alternatively, in some aspects, the hydroxyl number of the high molecular weight linear primary alcohol is from 50 to 103. Alternatively, in some aspects, the hydroxyl number of the high molecular weight linear primary alcohol is from 50 to 102. Alternatively, in some aspects, the hydroxyl number of the high molecular weight linear primary alcohol is from 50 to 101. Alternatively, in some aspects, the hydroxyl number of the high molecular weight linear primary alcohol is from 50 to 100. Alternatively, in some aspects, the hydroxyl number of the high molecular weight linear primary alcohol is from 50 to 99. Alternatively, in some aspects, the hydroxyl number of the high molecular weight linear primary alcohol is from 50 to 98. Alternatively, in some aspects, the hydroxyl number of the high molecular weight linear primary alcohol is from 50 to 97. Alternatively, in some aspects, the hydroxyl number of the high molecular weight linear primary alcohol is from 50 to 96. Alternatively, in some aspects, the hydroxyl number of the high molecular weight linear primary alcohol is from 50 to 95. Alternatively, in some aspects, the hydroxyl number of the high molecular weight linear primary alcohol is from 50 to 94. Alternatively, in some aspects, the hydroxyl number of the high molecular weight linear primary alcohol is from 50 to 93. Alternatively, in some aspects, the hydroxyl number of the high molecular weight linear primary alcohol is from 50 to 92. Alternatively, in some aspects, the hydroxyl number of the high molecular weight linear primary alcohol is from 50 to 91. Alternatively, in some aspects, the hydroxyl number of the high molecular weight linear primary alcohol is from 50 to 90. Alternatively, in some aspects, the hydroxyl number of the high molecular weight linear primary alcohol is from 50 to 89. Alternatively, in some aspects, the hydroxyl number of the high molecular weight linear primary alcohol is from 50 to 88. Alternatively, in some aspects, the hydroxyl number of the high molecular weight linear primary alcohol is from 50 to 87. Alternatively, in some aspects, the hydroxyl number of the high molecular weight linear primary alcohol is from 50 to 86. Alternatively, in some aspects, the hydroxyl number of the high molecular weight linear primary alcohol is from 50 to 85. Alternatively, in some aspects, the hydroxyl number of the high molecular weight linear primary alcohol is from 50 to 84. Alternatively, in some aspects, the hydroxyl number of the high molecular weight linear primary alcohol is from 50 to 83. Alternatively, in some aspects, the hydroxyl number of the high molecular weight linear primary alcohol is from 50 to 82. Alternatively, in some aspects, the hydroxyl number of the high molecular weight linear primary alcohol is from 50 to 81. Alternatively, in some aspects, the hydroxyl number of the high molecular weight linear primary alcohol is from 50 to 80. Alternatively, in some aspects, the hydroxyl number of the high molecular weight linear primary alcohol is from 50 to 79. Alternatively, in some aspects, the hydroxyl number of the high molecular weight linear primary alcohol is from 50 to 78. Alternatively, in some aspects, the hydroxyl number of the high molecular weight linear primary alcohol is from 50 to 77. Alternatively, in some aspects, the hydroxyl number of the high molecular weight linear primary alcohol is from 50 to 76. Alternatively, in some aspects, the hydroxyl number of the high molecular weight linear primary alcohol is from 50 to 75. Alternatively, in some aspects, the hydroxyl number of the high molecular weight linear primary alcohol is from 50 to 74. Alternatively, in some aspects, the hydroxyl number of the high molecular weight linear primary alcohol is from 50 to 73. Alternatively, in some aspects, the hydroxyl number of the high molecular weight linear primary alcohol is from 50 to 72. Alternatively, in some aspects, the hydroxyl number of the high molecular weight linear primary alcohol is from 50 to 71. Alternatively, in some aspects, the hydroxyl number of the high molecular weight linear primary alcohol is from 50 to 70. Alternatively, in some aspects, the hydroxyl number of the high molecular weight linear primary alcohol is from 50 to 69. Alternatively, in some aspects, the hydroxyl number of the high molecular weight linear primary alcohol is from 50 to 68. Alternatively, in some aspects, the hydroxyl number of the high molecular weight linear primary alcohol is from 50 to 67. Alternatively, in some aspects, the hydroxyl number of the high molecular weight linear primary alcohol is from 50 to 66. Alternatively, in some aspects, the hydroxyl number of the high molecular weight linear primary alcohol is from 50 to 65. Alternatively, in some aspects, the hydroxyl number of the high molecular weight linear primary alcohol is from 50 to 64. Alternatively, in some aspects, the hydroxyl number of the high molecular weight linear primary alcohol is from 50 to 63. Alternatively, in some aspects, the hydroxyl number of the high molecular weight linear primary alcohol is from 50 to 62. Alternatively, in some aspects, the hydroxyl number of the high molecular weight linear primary alcohol is from 50 to 61. Alternatively, in some aspects, the hydroxyl number of the high molecular weight linear primary alcohol is from 50 to 60. Alternatively, in some aspects, the hydroxyl number of the high molecular weight linear primary alcohol is from 50 to 59. Alternatively, in some aspects, the hydroxyl number of the high molecular weight linear primary alcohol is from 50 to 58. Alternatively, in some aspects, the hydroxyl number of the high molecular weight linear primary alcohol is from 50 to 57. Alternatively, in some aspects, the hydroxyl number of the high molecular weight linear primary alcohol is from 50 to 56. Alternatively, in some aspects, the hydroxyl number of the high molecular weight linear primary alcohol is from 50 to 55. Alternatively, in some aspects, the hydroxyl number of the high molecular weight linear primary alcohol is from 50 to 54. Alternatively, in some aspects, the hydroxyl number of the high molecular weight linear primary alcohol is from 50 to 53. Alternatively, in some aspects, the hydroxyl number of the high molecular weight linear primary alcohol is from 50 to 52. Alternatively, in some aspects, the hydroxyl number of the high molecular weight linear primary alcohol is from 50 to 51.

In some aspects, the hydroxyl number of the high molecular weight linear primary alcohol is from 51 to 110. Alternatively, in some aspects, the hydroxyl number of the high molecular weight linear primary alcohol is from 52 to 109. Alternatively, in some aspects, the hydroxyl number of the high molecular weight linear primary alcohol is from 53 to 109. Alternatively, in some aspects, the hydroxyl number of the high molecular weight linear primary alcohol is from 54 to 109. Alternatively, in some aspects, the hydroxyl number of the high molecular weight linear primary alcohol is from 55 to 109. Alternatively, in some aspects, the hydroxyl number of the high molecular weight linear primary alcohol is from 56 to 109. Alternatively, in some aspects, the hydroxyl number of the high molecular weight linear primary alcohol is from 57 to 109. Alternatively, in some aspects, the hydroxyl number of the high molecular weight linear primary alcohol is from 58 to 109. Alternatively, in some aspects, the hydroxyl number of the high molecular weight linear primary alcohol is from 59 to 109. Alternatively, in some aspects, the hydroxyl number of the high molecular weight linear primary alcohol is from 60 to 109. Alternatively, in some aspects, the hydroxyl number of the high molecular weight linear primary alcohol is from 61 to 110. Alternatively, in some aspects, the hydroxyl number of the high molecular weight linear primary alcohol is from 62 to 109. Alternatively, in some aspects, the hydroxyl number of the high molecular weight linear primary alcohol is from 63 to 109. Alternatively, in some aspects, the hydroxyl number of the high molecular weight linear primary alcohol is from 64 to 109. Alternatively, in some aspects, the hydroxyl number of the high molecular weight linear primary alcohol is from 65 to 109. Alternatively, in some aspects, the hydroxyl number of the high molecular weight linear primary alcohol is from 66 to 109. Alternatively, in some aspects, the hydroxyl number of the high molecular weight linear primary alcohol is from 67 to 109. Alternatively, in some aspects, the hydroxyl number of the high molecular weight linear primary alcohol is from 68 to 109. Alternatively, in some aspects, the hydroxyl number of the high molecular weight linear primary alcohol is from 69 to 109. Alternatively, in some aspects, the hydroxyl number of the high molecular weight linear primary alcohol is from 70 to 109. Alternatively, in some aspects, the hydroxyl number of the high molecular weight linear primary alcohol is from 71 to 110. Alternatively, in some aspects, the hydroxyl number of the high molecular weight linear primary alcohol is from 72 to 109. Alternatively, in some aspects, the hydroxyl number of the high molecular weight linear primary alcohol is from 73 to 109. Alternatively, in some aspects, the hydroxyl number of the high molecular weight linear primary alcohol is from 74 to 109. Alternatively, in some aspects, the hydroxyl number of the high molecular weight linear primary alcohol is from 75 to 109. Alternatively, in some aspects, the hydroxyl number of the high molecular weight linear primary alcohol is from 76 to 109. Alternatively, in some aspects, the hydroxyl number of the high molecular weight linear primary alcohol is from 77 to 109. Alternatively, in some aspects, the hydroxyl number of the high molecular weight linear primary alcohol is from 78 to 109. Alternatively, in some aspects, the hydroxyl number of the high molecular weight linear primary alcohol is from 79 to 109. Alternatively, in some aspects, the hydroxyl number of the high molecular weight linear primary alcohol is from 80 to 109. Alternatively, in some aspects, the hydroxyl number of the high molecular weight linear primary alcohol is from 81 to 110. Alternatively, in some aspects, the hydroxyl number of the high molecular weight linear primary alcohol is from 82 to 109. Alternatively, in some aspects, the hydroxyl number of the high molecular weight linear primary alcohol is from 83 to 109. Alternatively, in some aspects, the hydroxyl number of the high molecular weight linear primary alcohol is from 84 to 109. Alternatively, in some aspects, the hydroxyl number of the high molecular weight linear primary alcohol is from 85 to 109. Alternatively, in some aspects, the hydroxyl number of the high molecular weight linear primary alcohol is from 86 to 109. Alternatively, in some aspects, the hydroxyl number of the high molecular weight linear primary alcohol is from 87 to 109. Alternatively, in some aspects, the hydroxyl number of the high molecular weight linear primary alcohol is from 88 to 109. Alternatively, in some aspects, the hydroxyl number of the high molecular weight linear primary alcohol is from 89 to 109. Alternatively, in some aspects, the hydroxyl number of the high molecular weight linear primary alcohol is from 90 to 109. Alternatively, in some aspects, the hydroxyl number of the high molecular weight linear primary alcohol is from 91 to 110. Alternatively, in some aspects, the hydroxyl number of the high molecular weight linear primary alcohol is from 92 to 109. Alternatively, in some aspects, the hydroxyl number of the high molecular weight linear primary alcohol is from 93 to 109. Alternatively, in some aspects, the hydroxyl number of the high molecular weight linear primary alcohol is from 94 to 109. Alternatively, in some aspects, the hydroxyl number of the high molecular weight linear primary alcohol is from 95 to 109. Alternatively, in some aspects, the hydroxyl number of the high molecular weight linear primary alcohol is from 96 to 109. Alternatively, in some aspects, the hydroxyl number of the high molecular weight linear primary alcohol is from 97 to 109. Alternatively, in some aspects, the hydroxyl number of the high molecular weight linear primary alcohol is from 98 to 109. Alternatively, in some aspects, the hydroxyl number of the high molecular weight linear primary alcohol is from 99 to 109. Alternatively, in some aspects, the hydroxyl number of the high molecular weight linear primary alcohol is from 100 to 109. Alternatively, in some aspects, the hydroxyl number of the high molecular weight linear primary alcohol is from 101 to 110. Alternatively, in some aspects, the hydroxyl number of the high molecular weight linear primary alcohol is from 102 to 109. Alternatively, in some aspects, the hydroxyl number of the high molecular weight linear primary alcohol is from 103 to 109. Alternatively, in some aspects, the hydroxyl number of the high molecular weight linear primary alcohol is from 104 to 109. Alternatively, in some aspects, the hydroxyl number of the high molecular weight linear primary alcohol is from 105 to 109. Alternatively, in some aspects, the hydroxyl number of the high molecular weight linear primary alcohol is from 106 to 109. Alternatively, in some aspects, the hydroxyl number of the high molecular weight linear primary alcohol is from 107 to 109. Alternatively, in some aspects, the hydroxyl number of the high molecular weight linear primary alcohol is from 108 to 109.

In some aspects, the hydroxyl number of the high molecular weight linear primary alcohol is 110, or, alternatively, 109, or 108, or 107, or 106, or 105, or 104, or 103, or 102, or 101, or 100, or 99, or 98, or 97, or 96, or 95, or 94, or 93, or 92, or 91, or 90, or 89, or 88, or 87, or 86, or 85, or 84, or 83, or 82, or 81, or 80, or 79, or 78, or 77, or 76, or 75, or 74, or 73, or 72, or 71, or 70, or 69, or 68, or 67, or 66, or 65, or 64, or 63, or 62, or 61, or 60, or 59, or 58, or 57, or 56, or 55, or 54, or 53, or 52, or 51, or 50.

In some aspects, the hydroxyl number of the high molecular weight linear primary alcohol is 50.

In some aspects, the hydroxyl number of the high molecular weight linear primary alcohol is 65.

In some aspects, the hydroxyl number of the high molecular weight linear primary alcohol is 83.

In some aspects, the polydispersity of the molecular weight to carbon chain length is low. Examples of a high molecular weight linear primary alcohol having a low polydispersity of the molecular weight to carbon chain length, include the high molecular weight linear primary alcohol sold under the trade name UNILIN™. In some aspects, the high molecular weight linear primary alcohol is the high molecular weight linear primary alcohol sold under the trade name UNILIN™ 550. In some aspects, the high molecular weight linear primary alcohol is the high molecular weight linear primary alcohol sold under the trade name UNILIN™ 700. In some aspects, the high molecular weight linear primary alcohol is the high molecular weight linear primary alcohol sold under the trade name UNILIN™ 1000.

In some aspects, the high molecular weight linear primary alcohol is present in the composition in an amount sufficient to improve the dispersion of the volatile active substance, when the composition is incorporated into a candle. In some aspects, the improvement is determined by comparing the dispersion of the volatile active substance that is incorporated into a candle lacking the high molecular weight linear primary alcohol. In some aspects, volatile active substance dispersion is evaluated by GC-MS, using a sample of the head space of a candle sample.

In some aspects, the sufficient amount of the high molecular weight linear primary alcohol is from 0.01% to 25% w/w of the composition. Alternatively, the sufficient amount of the high molecular weight linear primary alcohol is from 0.1% to 5% w/w of the composition. Alternatively, the sufficient amount of the high molecular weight linear primary alcohol is from 0.15% to 5% w/w of the composition. Alternatively, the sufficient amount of the high molecular weight linear primary alcohol is from 0.1% to 0.6% w/w of the composition. Alternatively, the sufficient amount of the high molecular weight linear primary alcohol is from 0.05% to 0.6% w/w of the composition.

In some aspects, the sufficient amount of the high molecular weight linear primary alcohol is 25% w/w of the composition. Alternatively, the sufficient amount of the high molecular weight linear primary alcohol is 24, or 23, or 22, or 21, or 20, or 15, or 10, or 5, or 1, or 0.9, or 0.8, or 0.7, or 0.6, or 0.5, or 0.4, or 0.3, or 0.2, or 0.1, or 0.09, or 0.08, or 0.07, or 0.06, or 0.05, or 0.04, or 0.03, or 0.02, or 0.01, or 0.005, or 0.001% w/w of the composition.

In some aspects, the sufficient amount of the high molecular weight linear primary alcohol is from 0.05% to 0.6% w/w of the composition when incorporated into a candle. Alternatively, the sufficient amount of the high molecular weight linear primary alcohol is from 0.1% to 0.6% w/w of the composition when incorporated into a candle. Alternatively, the sufficient amount of the high molecular weight linear primary alcohol is from 0.15% to 0.6% w/w of the composition when incorporated into a candle. Alternatively, the sufficient amount of the high molecular weight linear primary alcohol is from 0.2% to 0.6% w/w of the composition when incorporated into a candle. Alternatively, the sufficient amount of the high molecular weight linear primary alcohol is from 0.25% to 0.6% w/w of the composition when incorporated into a candle. Alternatively, the sufficient amount of the high molecular weight linear primary alcohol is from 0.3% to 0.6% w/w of the composition when incorporated into a candle. Alternatively, the sufficient amount of the high molecular weight linear primary alcohol is from 0.35% to 0.6% w/w of the composition when incorporated into a candle. Alternatively, the sufficient amount of the high molecular weight linear primary alcohol is from 0.4% to 0.6% w/w of the composition when incorporated into a candle. Alternatively, the sufficient amount of the high molecular weight linear primary alcohol is from 0.45% to 0.6% w/w of the composition when incorporated into a candle. Alternatively, the sufficient amount of the high molecular weight linear primary alcohol is from 0.5% to 0.6% w/w of the composition when incorporated into a candle. Alternatively, the sufficient amount of the high molecular weight linear primary alcohol is from 0.55% to 0.6% w/w of the composition when incorporated into a candle.

In some aspects, the sufficient amount of the high molecular weight linear primary alcohol is from 0.05% to 0.55% w/w of the composition when incorporated into a candle. Alternatively, the sufficient amount of the high molecular weight linear primary alcohol is from 0.05% to 0.5% w/w of the composition when incorporated into a candle. Alternatively, the sufficient amount of the high molecular weight linear primary alcohol is from 0.05% to 0.45% w/w of the composition when incorporated into a candle. Alternatively, the sufficient amount of the high molecular weight linear primary alcohol is from 0.05% to 0.4% w/w of the composition when incorporated into a candle. Alternatively, the sufficient amount of the high molecular weight linear primary alcohol is from 0.05% to 0.35% w/w of the composition when incorporated into a candle. Alternatively, the sufficient amount of the high molecular weight linear primary alcohol is from 0.05% to 0.3% w/w of the composition when incorporated into a candle. Alternatively, the sufficient amount of the high molecular weight linear primary alcohol is from 0.05% to 0.25% w/w of the composition when incorporated into a candle. Alternatively, the sufficient amount of the high molecular weight linear primary alcohol is from 0.05% to 0.2% w/w of the composition when incorporated into a candle. Alternatively, the sufficient amount of the high molecular weight linear primary alcohol is from 0.05% to 0.15% w/w of the composition when incorporated into a candle. Alternatively, the sufficient amount of the high molecular weight linear primary alcohol is from 0.05% to 0.1% w/w of the composition when incorporated into a candle.

Alternatively, the sufficient amount of the high molecular weight linear primary alcohol is 0.6, or 0.55, or 0.5, or 0.45, or 0.4, or 0.35, or 0.3, or 0.25, or 0.2, or 0.15, or 0.1, or 0.55% w/w of the composition when incorporated into a candle.

In some aspects, the composition further comprises a cold throw in wax. In some aspects, the composition further comprises a warm throw in wax. In some aspects, the wax is selected from the group consisting of: a paraffin wax, a vegetable-based wax, and a mixture of a paraffin wax and a vegetable-based wax.

As used herein, the term "wax" refers to a substance that is a plastic to brittle solid at ambient temperatures. Suitable waxes for certain aspects presented herein include, but are not limited to, paraffin wax, microcrystalline wax, beeswax, animal wax, vegetable wax, mineral wax, synthetic wax, and mixtures thereof. In addition to wax semi-solids (such as petrolatum), liquids, synthetic polymers and mixtures of synthetic polymers with one or more organic compounds may be used in a candle material or part of a candle material. Other typically used candle fuel source components such as hydrocarbon oil, stearic acid, may also be included in the candle material.

In some aspects, the wax formulation may further comprise additional optional ingredients to provide enhanced or additional aesthetic and/or functional improvements. In particular, the additional materials that may be included in the wax formulation include coloring agents, decorative materials, solvents, stabilizers, antioxidants, and UV blockers. Such optional ingredients do not warrant a more detailed description here, which would in any case not be exhaustive. The skilled person is capable to select them on the basis of his general knowledge and the desired characteristics of the candle. In particular, the kind and amount of the additional ingredients are selected among those that do not alter the structure or the burning properties of the wax formulation.

The volatile active substance may be any type of volatile active substance. In some aspects it is a perfume, a malodor counteractant, an antibacterial agent, an insect repellent or any combination thereof. In some aspects, the volatile active substance is a perfume.

As used herein, the term "perfume" is meant as including any perfuming ingredient or a mixture thereof. A "perfuming ingredient" is meant here as a compound which is of current use in the perfumery industry, i.e. a compound which is used as active ingredient in perfumed candles in order to impart a hedonic effect into its surrounding. In other words, such an ingredient or mixture, to be considered as being a perfuming one, must be recognized by a person skilled in the art of perfumery as being able to impart or modify in a positive or pleasant way the odor of a candle, and not just as having an odor. Moreover, this definition is also meant to include compounds that do not necessarily have an odor but are capable of modulating the odor of a perfuming composition and, as a result, of modifying the perception by a user of the odor of such a composition.

The nature and type of these perfuming ingredients do not warrant a more detailed description here, which in any case would not be exhaustive, the skilled person being able to select them on the basis of his general knowledge, the intended use or application and the desired organoleptic effect. In general terms, these perfuming ingredients belong to chemical classes as varied as alcohols, aldehydes, ketones, esters, ethers, acetates, nitriles, terpene hydrocarbons, nitrogenous or sulphurous heterocyclic compounds and essential oils, and said perfuming ingredients can be of natural or synthetic origin. Many of these ingredients are in any case listed in reference texts such as the book by S. Arctander, Perfume and Flavor Chemicals, 1969, Montclair, N.J., USA, or its more recent versions, or in other works of a similar nature, as well as in the abundant patent literature in the field of perfumery. It is also understood that said ingredients may also be compounds known to release in a controlled manner various types of perfuming compounds.

By the term "malodor counteractant" or "malodor counteracting ingredient" is meant compounds which are capable of reducing the perception of malodor, i.e. of an odor that is unpleasant or offensive to the human nose by counteracting and/or masking malodors. In a particular aspects, malodor counteractants have the ability to react with key compounds causing known malodors. The reactions result in reduction of the malodor materials' airborne levels and consequent reduction in the perception of the malodor.

Non-limiting examples of suitable insect repellants include citronella, dimethyl phthalate and n,n-dimethyl-m-tolumide.

The volatile active substance is typically present in candle between 10 and 25% by weight, based on the total weight of the composition.

One aspect presented herein, provides a method comprising:

a) admixing i. a volatile active substance, and ii. a high molecular weight linear primary alcohol to form a mixture;

b) adding the mixture to a wax, selected from the group consisting of: a paraffin wax, a vegetable-based wax, and a mixture of a paraffin wax and a vegetable-based wax; and c) forming a candle, wherein the high molecular weight linear primary alcohol is present in the composition in an amount sufficient to improve the dispersion of the volatile active substance, when the composition is incorporated into a candle, compared to a dispersion of the volatile active substance that is incorporated into a candle lacking the high molecular weight linear primary alcohol, and wherein the hydroxyl number of the high molecular weight linear primary alcohol is from 66 to 110.

In general, known methods for manufacturing candles can be used to provide the candles disclosed herein. In some aspects, high melting point wax coated wicks are cut into a desired length then crimped into small metal wick stands. The wick stands are attached to the bottom of a container. On top of the container, a metal wick guide is placed to keep the wicks vertical. The wax formulation is poured into the container to the desired level. The candle is cooled to room temperature, followed by removal of the metal wick guide. Optionally, an accelerated cooling process can be used. The wicks are trimmed to right length to yield a finished candle. Other approaches, including those common in the industry, may be used.

In some aspects, the high molecular weight linear primary alcohol is added to the wax with heat and agitation, wherein the addition results in a wax mixture having a uniform appearance.

The present invention is best illustrated but is not limited to the following examples.

EXAMPLES

Example 1

Wax Formulations According to Some Aspects Presented Herein

| Ingredient | Amount (w/w of the wax formulation) |
|---|---|
| Paraffin | 40 |
| Soy wax | 20 |
| Beeswax | 10 |
| Palm wax | 10 |
| Coconut wax | 5 |
| Fischer Trop | 5 |
| Microcrystalline wax | 5 |
| Tallow | 5 |

| Ingredient | Amount (w/w of the wax formulation) |
|---|---|
| Paraffin | 70 |
| Soy wax | 29.85 |
| UNILIN 700 | 0.15 |

| Ingredient | Amount (w/w of the wax formulation) |
|---|---|
| Sow wax | 50 |
| Paraffin | 49.5 |
| UNILIN 1000 | 0.5 |

A volatile active substance is incorporated into the wax formulations, and the dispersion of the volatile active substance is evaluated by removing a 0.5 gram core sample of the wax mixture with a #2 cork borer, placing the sample in 20 ml head space vial, sealing with a septum cap and evaluating the head space by GC-MS.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

The invention claimed is:

1. A composition, comprising:

a. an ingredient selected from the group consisting of alcohols, aldehydes, ketones, esters, ethers, acetates, nitriles, terpene hydrocarbons, nitrogenous or sulphurous heterocyclic compounds, essential oils or combinations thereof;

b. 0.05% to 0.45% w/w of a high molecular weight linear primary alcohol, wherein the hydroxyl number of the high molecular weight linear primary alcohol is about 83; and c. a wax selected from the group consisting of a paraffin wax, a vegetable-based wax, and a mixture of a paraffin wax and a vegetable-based wax.

2. The composition of claim 1, wherein the high molecular weight linear primary alcohol has a melting point from 87 degrees Celsius to 110 degrees Celsius.

3. The composition of claim 1, wherein the iodine value of the high molecular weight linear primary alcohol does not exceed 2.

4. The composition of claim 1, wherein the sufficient amount of the high molecular weight linear primary alcohol is from 0.05% to 0.2% w/w of the composition.

5. A composition, comprising:

a. an ingredient selected from the group consisting of alcohols, aldehydes, ketones, esters, ethers, acetates, nitriles, terpene hydrocarbons, nitrogenous or sulphurous heterocyclic compounds, essential oils or combinations thereof;

b. a wax selected from the group consisting of a paraffin wax, a vegetable-based wax, and a mixture of a paraffin wax and a vegetable-based wax; and c. 0.05% to 0.2% w/w of a high molecular weight linear primary alcohol, wherein the hydroxyl number of the high molecular weight linear primary alcohol is about 83.

6. The composition of claim 5, wherein the high molecular weight linear primary alcohol has a melting point from 87 degrees Celsius to 110 degrees Celsius.

7. The composition of claim 5, wherein the iodine value of the high molecular weight linear primary alcohol does not exceed 2.

8. A method, comprising the steps of:

a. admixing i. an ingredient selected from the group consisting of alcohols, aldehydes, ketones, esters, ethers, acetates, nitriles, terpene hydrocarbons, nitrogenous or sulphurous heterocyclic compounds, essential oils or combinations thereof, and ii. 0.05% to 0.45% w/w of a high molecular weight linear primary alcohol, wherein the hydroxyl number of the high molecular weight linear primary alcohol is about 83, to form a mixture;

b. adding the mixture to a wax, selected from the group consisting of a paraffin wax, a vegetable-based wax, and a mixture of a paraffin wax and a vegetable-based wax; and c. forming a candle from the mixture formed in step b.

9. The method of claim 8, wherein the high molecular weight linear primary alcohol has a melting point from 87 degrees Celsius to 110 degrees Celsius.

10. The method of claim 8, wherein the iodine value of the high molecular weight linear primary alcohol does not exceed 2.

* * * * *